US007491132B2

(12) United States Patent
Bush, III et al.

(10) Patent No.: US 7,491,132 B2
(45) Date of Patent: Feb. 17, 2009

(54) GOLF SWING GUIDE

(75) Inventors: Tony Bush, III, San Rafael, CA (US); Frank Benner Falkenburg, Sausalito, CA (US)

(73) Assignee: FigJam Inc., Mill Valley, CA (US)

( * ) Notice: Subject to any disclaimer, the term of this patent is extended or adjusted under 35 U.S.C. 154(b) by 0 days.

(21) Appl. No.: 11/457,109

(22) Filed: Jul. 12, 2006

(65) Prior Publication Data

US 2007/0015597 A1 Jan. 18, 2007

Related U.S. Application Data

(60) Provisional application No. 60/760,133, filed on Jan. 19, 2006, provisional application No. 60/698,633, filed on Jul. 13, 2005.

(51) Int. Cl.
*A63B 69/36* (2006.01)

(52) U.S. Cl. ..... 473/257; 473/261

(58) Field of Classification Search ..... 473/218, 473/219, 257, 258, 259, 260–268, 270
See application file for complete search history.

(56) References Cited

U.S. PATENT DOCUMENTS

| | | | | | |
|---|---|---|---|---|---|
| 635,794 | A | * | 10/1899 | Mason | 119/492 |
| 3,489,416 | A | * | 1/1970 | Mark | 473/229 |
| 4,383,687 | A | * | 5/1983 | Wolff | 473/267 |
| 5,131,659 | A | * | 7/1992 | Lindberg, Jr. | 473/267 |
| 5,294,124 | A | * | 3/1994 | Florian | 473/267 |
| 6,500,075 | B1 | | 12/2002 | McDevitt | |
| 6,988,957 | B2 | | 1/2006 | Bender | |
| 2005/0143185 | A1 | * | 6/2005 | Cowup | 473/268 |
| 2005/0209015 | A1 | | 9/2005 | Costa | |
| 2006/0122001 | A1 | | 6/2006 | Gaddy | |

* cited by examiner

*Primary Examiner*—Nini Legesse
(74) *Attorney, Agent, or Firm*—Steven A. Nielsen; Allman & Nielsen, P.C.

(57) ABSTRACT

Three rectangular panels create an adjustable golf swing plane and physical barrier suitable for teaching and practicing any golf shot with any golf club. In the preferred embodiment, the three panels are pivotally secured by a living hinge system. One side of the base panel is grooved to secure the panel used for driving. For bunker shots, the base panel rotates 180 degrees for placement under sand. For putting, a putter slides across the putting panel and an integrated mirror provides the golfer visual alignment of the golfer's eyes, shoulders and putter.

2 Claims, 5 Drawing Sheets

GOLF SWING GUIDE

CROSS REFERENCE TO RELATED APPLICATION

This application claims priority to Provisional Application Ser. No. 60/698,633 for "Golf swing guide" having a filing date of Jul. 13, 2005, the disclosure of which is herein incorporated by reference in its entirety. This application also claims the benefit of Provisional Application Ser. No. 60/760,133 for "Insight putting mirror-revised" with a filing date of Jan. 19, 2006, the disclosure of which is herein incorporated by reference in its entirety.

BACKGROUND OF THE INVENTION

1. Field of the Invention

The invention relates to golf equipment, and in particular, golf aids for improving, practicing and/or teaching golf club swings.

2. Description of the Related Art

Golf is a game that challenges, frustrates, and absorbs millions of people from across the world. While millions of golfers attempt to emulate the fluid swing and perfect body geometry of golf professionals, few players truly play golf. Most people taking to the golf course may be observed spraying golf balls to the hither regions of surrounding parking lots, spectators, and ponds. While other golf teaching aids are known in the art and claim to be effective, they fail to provide the practical, economic or proficient means disclosed by the present invention.

U.S. patent application 2005/0209015 by Costa, published Sep. 22, 2005 uses a pair of elastic cords suspended above the ground to create a swing plane. The elastic cords are supported by a myriad of poles and parts that are not easily transported. Costa fails to provide a training system that may be transported in a standard sized golf bag or that may be quickly assembled. Costa also requires a flat surface surrounding the golfer.

U.S. patent application 2005/0122001 by Gaddy, published Jun. 8, 2006 uses multiple laser beams and diffractional optical elements to produce lines on the ground which are used for alignment of the golfer and golf ball. Gaddy requires the use of complex, delicate and expensive electronic equipment. Gaddy fails to provide any physical barrier to guide a golf club along a swing plane. A golf club striking the Gaddy invention would destroy the delicate optical equipment and laser producing apparatus.

U.S. Pat. No. 6,988,957 by Bender granted on Jan. 24, 2006 provides a barrier that is struck when a golf swing is out of the defined golf swing plane. Unfortunately, Bender relies upon multiple apparatuses mounted upon a large and heavy support base. The Bender invention is not easily moved or easily adjusted for different golf strokes.

U.S. Pat. No. 6,500,075 by McDevitt granted on Dec. 31, 2002 uses two free floating hinged panels that form an inverted "V". While the angularity of the inverted "V" may be adjusted, McDevitt fails to provide means of securely or durably position the panels. McDevitt relies upon a pair of bulky, heavy, and expensive cam hinges that do not hold up to the repeated impact that any golf training aid may be expected to endure.

McDevitt relies upon markings on the panels to assist in alignment and fails to provide means of hitting a golf ball placed between the golfer and panels. McDevitt uses foot guide strips placed perpendicularly to the panels. Such foot glide strips are placed between the panels and golfer and prevent placement of a golf ball on the golfer side of the panels.

McDevitt fails to provide means of attaching a mirror for golfer alignment and fails to provide a base panel or splashboard for placement in the sand, under a golf ball. McDevitt is not suitable for sand shots and fails to provide a base panel to secure the inverted "V" panels at different angles. McDevitt fails to provide a dedicated panel for driving or a dedicated panel for putting.

McDevitt fails to provide rounded panel edges or rounded hinges, and thus exposes golfers and their golf clubs to snagging and excessive damage. The extra foot guide strips add bulk to the McDevitt invention and prevent the McDevitt invention from easily fitting into a standard golf bag.

SUMMARY OF THE INVENTION

The invention overcomes shortfalls in the related art by providing a three panel system that uses a base panel to secure the angle of the two club guiding panels. The base panel may be rotated and buried in the sand to guide a sand wedge through the sand, teaching a golfer how to splash a ball out of a bunker. The invention provides one durable, compact, easily transportable and economic tool to teach the proper swing for every club and for every shot that a golfer might encounter.

The invention overcomes shortfalls in the art by use of a flexible living hinge system that is more durable, economical and lighter than the bulky cam hinge system of the related art. Unlike the related art, the invention provides three panels that may be folded into a flat and thin configuration allowing for easy transport in a standard golf club bag and for an attractive marketing display in a retail store. In the preferred embodiment, the panels of the invention are rounded, and thus are not prone to snagging when placed is a golf bag. The rounded edges also prevent snagging by golf clubs swinging near the panel system.

The flexible impact resistant living hinge system provides for smooth surfaces that will not catch or snare a golfer or golf club. Due to the living hinge system, the panels of the disclosed invention may be safely rounded and the panel system may be folded in a compact manner.

Unlike the related art, the invention does not use foot guide strips. The absence of guide strips allows a golfer to strike a ball located between the golfer and the invention. Thus, a golf ball may be placed on either side of the invention, allowing the invention to create a physical barrier and swing path for every club and for every shot. The ability to hit balls on either side of the panel assembly also allows golfers to preserve the putting face or putting panel. Unlike the related art, the panel assembly may be turned 180 degrees so as to not expose the putting pannel to impact during driving shots or iron shots. Keeping the putting panel smooth and undamaged allows a putter to smoothly slide across the face of the putter panel.

The absence of foot guide strips allows the invention to create a physical barrier and swing path to hit a draw (right to left ball flight) or a fade (left to right ball flight). The draw and fade may be struck with the ball between the golfer and panels. Such ball position is not possible with the use of foot guide strips or other components placed between the panels and the golfer.

The ability to strike a ball between the golfer and panel assembly is exceptionally important for beginning or average golfers who tend to strike the ball from the outside swing plane or outside the target line causing a slice. Striking the ball with the invention behind the ball, FIG. 3, encourages an approach from inside the target line.

The invention accepts an optional mirror assembly that fits into the base panel or ground panel. The disclosed mirror assembly may be an integral part of the disclosed barrier system or may be used as a separate guiding system. The mirror includes a "V" notch where a golf ball may be placed. A "V" notch or void is located at either end of the mirror to allow proper position of the ball for either right handed or left handed players. The mirror assembly folds in half, allowing for easy transport and the display of promotional graphics on the backsides. The top sides of the mirror assembly are marked with lines or other indicia to allow a golfer to see if the club face is square and if the golfer's eyes are over the ball, and if the golfer's shoulders are square. The mirror assembly folds in half to provide a convenient score card holder.

In the preferred embodiment, the barrier portion or panel assembly of the invention comprises three impact resistant panels with each panel performing different and unique functions not seen in the related art. Panel 1 is sometimes known as the base panel. The base panel typically rests on the ground and is used to support the $2^{nd}$ panel or putting panel or putting face and the $3^{rd}$ panel or driving panel. Panels 1 and 2 and panels 2 and 3 are connected using a unique living hinge system that runs the length of the panels 2 and 3. There is no hinge section in the middle of panels 1 and 2, to allow an insertion pocket for the optional reflective component. In the alternative embodiment, a living hinge system replaces the impact resistant living hinge system.

In either embodiment, one side of base panel 1 has longitudinal groves capable of accepting the free edge of the $3^{rd}$ panel or driving panel, creating a secure triangle. The $3^{rd}$ panel may be secured in any of the groves of the $1^{st}$ panel, allowing for adjustment of the panel triangle to fit the intended lie of the desired golf swing plane. For greater versatility, the $3^{rd}$ panel may be placed past the $1^{st}$ panel and edged or placed on or into the ground. Such a position is useful for driving were a lower angle is desired. For driving and strokes with irons, the $3^{rd}$ panel creates a physical and visible swing plane. Muscle memory is developed as the $3^{rd}$ panel will be unintentionally struck when a swing is out of plane.

Unlike the related art, the invention provides special training for putting and sand shots. Unlike drives and iron shots, putting is practiced by placing the heel of the putter on the putting panel or $2^{nd}$ panel. Due to the delicacy and fine motor skills required for effective putting, the putter travels along the smooth surface of the putting panel teaching the golfer a proper putting swing.

To teach and/or practice the critical skill of ball and body alignment, an optional mirror assembly fits into a void in the ground panel. The mirror assembly provides a ball notch for ball placement and lines to assist in squarely positioning the putter and the head of the golfer. The mirror assembly has means to allow a golfer to see and align her eyes in proper putting position. The mirror assembly is used for putting only and may be used with out the disclosed panel barrier system.

Unlike the related art, the invention teaches the proper splash required for sand or bunker shots. Starting from a putting position, the base panel pivots approximately 180 degrees and provides a guide surface in the sand and below the ball. The smooth side of the base panel acts as a physical barrier under the sand to teach the proper depth of a splash or sand shot. Unlike all other golf swings, a sand shot requires that the sand under the ball be splashed or struck.

The invention is less damaging to golf clubs as the panels may be made from a foam core, allowing for greater damping when stuck. The flexible impact resistant hinge system also allows for greater safety as it allows for greater impact without damage to invention, golfer, or the golfer's equipment. Even for a novice, golf swings may approach 70 miles per hour and often damage the swing guides of the related art and the striking golf clubs.

DETAILED DESCRIPTION OF CERTAIN EMBODIMENTS

The following detailed description is directed to certain specific embodiments of the invention. However, the invention can be embodied in a multitude of different ways as defined and covered by the claims. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

A living hinge is a hinge or flexure bearing with no moving parts. It is generally a thin section of material that bends to allow movement. For the invention, a living hinge piece may fit into the panels in a variety of forms. The living hinge may be made from TPE (thermoplastic elastomer) or other similar material The use of TPE and similar material makes the living hinge impact resistant. In alternative embodiments, the panels themselves may be connected by thin portions of panel material that bend.

Figure 1:
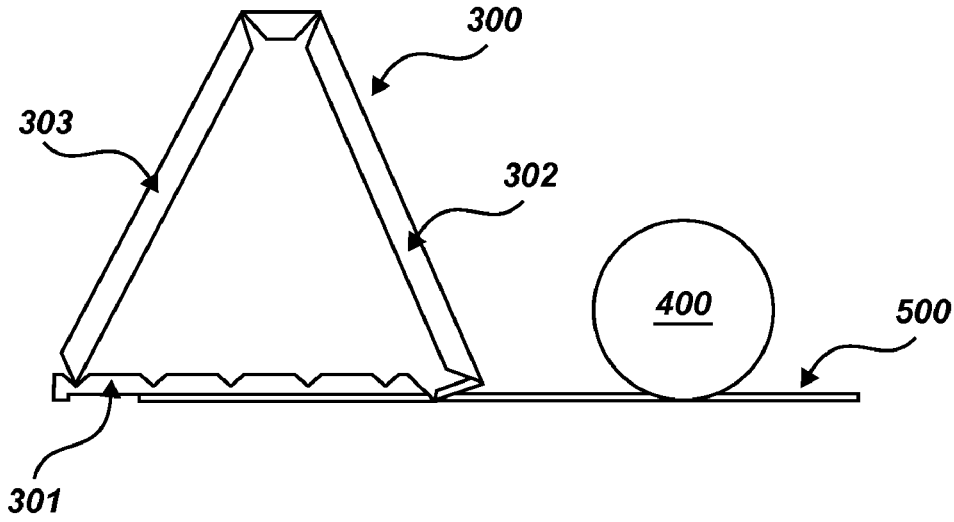
FIG. 1 is an elevation view of the panel assembly, reflective assembly, and ball in putting position.

FIG. 1 shows a living hinge embodiment 300 used with the disclosed mirror or reflective assembly 500 and a golf ball 400. The base panel 301 or $1^{st}$ panel has groves or indentations which may secure the driving panel 303 or $3^{rd}$ panel. The putting panel 302 or $2^{nd}$ panel faces the ball for putting. The heel of the putter may slide across the putting surface 302 to smoothly strike the ball. Sliding the putter across the smooth surface of the putting panel develops muscle memory so that the golfer will be able to execute a proper putt without the panel system.

Figure 2:
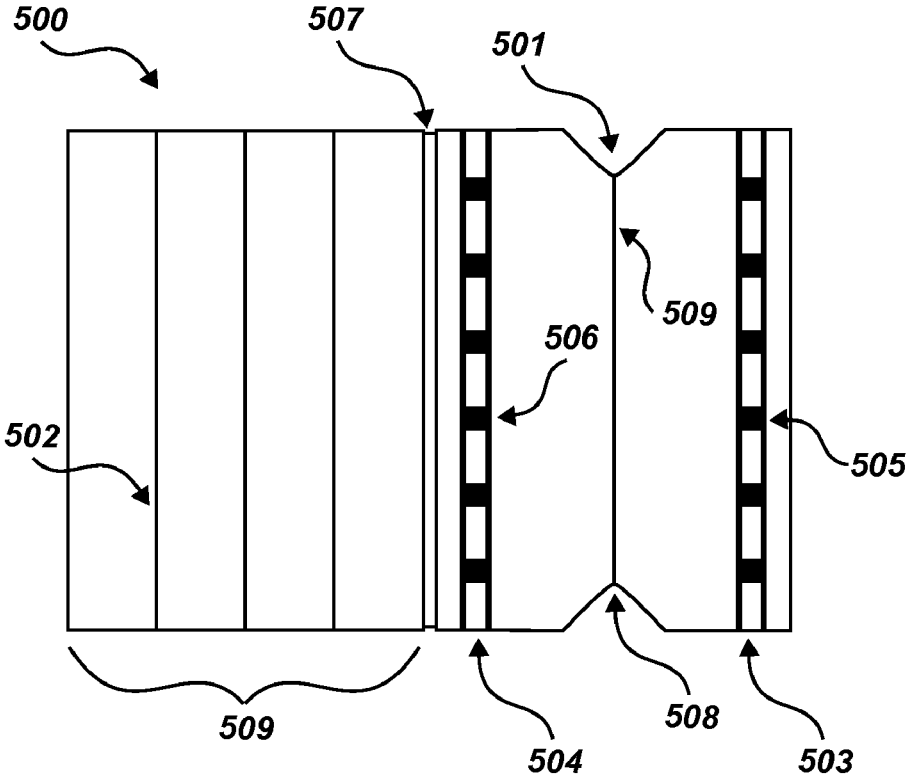
FIG. 2 is a plan view of the mirror assembly.

FIG. 2 shows the optional reflective assembly 500 which is flexible along hinge point 507 allowing the assembly to be used has a holder for a golf scorecard and/or carried in a pocket. The reflective assembly 500 may provide a firm backing for writing on a golf scorecard.

Ball notches at 501 and 508 provide a guide to place a golf ball. Line 509 runs between the ball notches providing a visual reference for aligning the golfer's eyes to the ball. Marking columns 504 and 503 provide reference points for putter head alignment. For example, for a right-handed golfer, markings 506 and 505 could be used to square a putter with respect to a ball in ball notch 501. For a left-handed golfer, markings 506 and 505 could be used to square a putter with respect to a ball in ball notch 508. The barrier assembly 300 may be rotated 180 degrees to accommodate right-handed or left-handed players. When the reflective assembly 500 is used with the barrier assembly or panel system 300, the unnotched side 509 of the reflective assembly fits under the base panel 301 and extends out and in front of the putting face 302.

When used without the panel assembly, side 509 is exposed and may be used for shoulder alignment. Line 502 could be used as a reference line for shoulder alignment.

Figure 3:
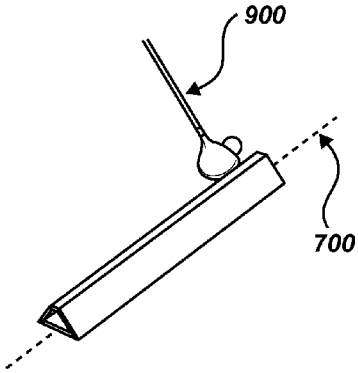
FIG. 3 is a perspective view of a drive shot using the panel assembly.

FIG. 3 shows a golfer using a driver in the "A" position, where the golf ball is between the golfer and panel system. FIG. 3 shows the panel system in direct aliment 700 to the target area. This alignment is useful for straight drives.

Figure 4:
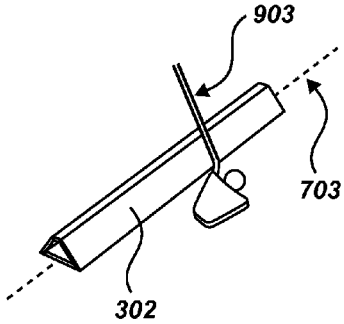
FIG. 4 is a perspective view of a putting shot using the panel assembly.

FIG. 4 shows a putter 903 sliding across the putting panel 302. The panel system is in the "B" position where the panels are between the ball and the golfer.

Figure 5:
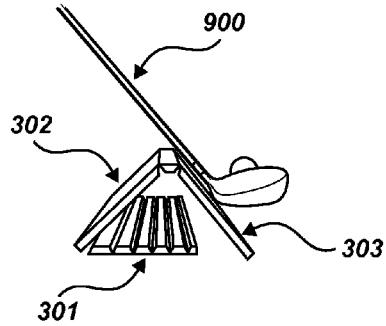
FIG. 5 is a perspective view of a low lie angle drive shot using the panel assembly.

FIG. 5 shows a driver 900 aligned in the "B" position, striking a ball adjacent to the driver or iron panel 303. The putter panel 302 faces the golfer to save the surface of the putter panel from impact from the club.

Figure 6:
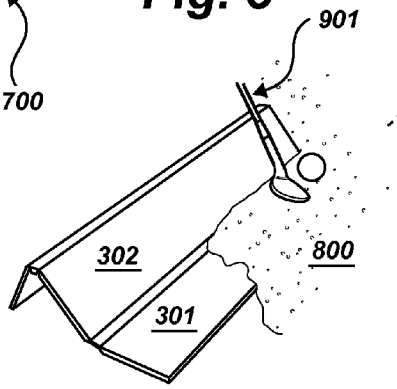
FIG. 6 is a perspective view of a sand shot using the panel assembly.

FIG. 6 illustrates the base panel 301 rotated 180 degrees to act as a splashboard for bunker use. The base panel 301, used as a splashboard, is placed approximately one half inch under the sand 800. A sand wedge 901 bounces off the splashboard 301 to teach proper bunker strokes. The splashboard acts as a guide for proper stroke depth into the sand and encourages follow through as the sand wedge strikes the splashboard. The use of the splashboard focuses the golfer on removing the sand under the ball with the sand wedge. Due to the different lies of bunker shots, the putter panel 302 is not used as a reference plane and is not struck or damaged during bunker shots.

Figure 7:
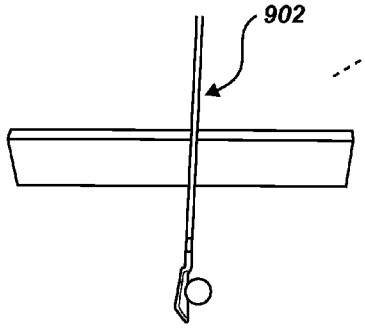
FIG. 7 is a perspective view of an iron shot using the panel assembly.

FIG. 7 shows a club iron 902 used in position "B" with respect to the panel system.

Figure 8:
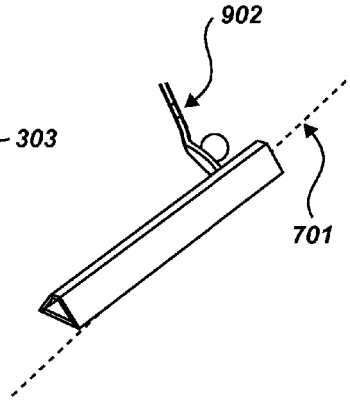
FIG. 8 is a perspective view of a draw swing using the panel assembly.

FIG. 8 shows an iron 902 in position "A". The panel assembly is aligned for a draw stroke with respect to the target line 701 that leads to the intended target. Aligning the panel assembly and the golfer slightly to the right of the target while the clubface is aimed at the target will result in a draw stroke.

Figure 9:
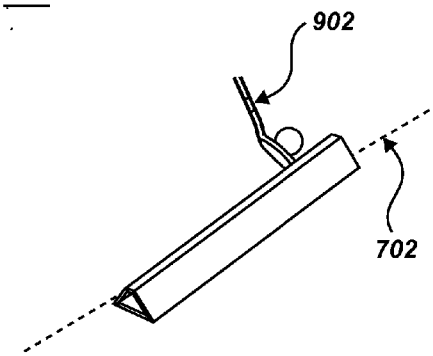
FIG. 9 is a perspective view of a fade swing using the panel assembly.

FIG. 9 shows an club iron 902 in position "A" and with the panel assembly aligned for a fade stroke with respect to target line 702 that leads to the intended target. Aligning the panel assembly and the golfer slightly to the left of the target while aiming the clubface toward the target will result in a fade stroke.

Figure 10:
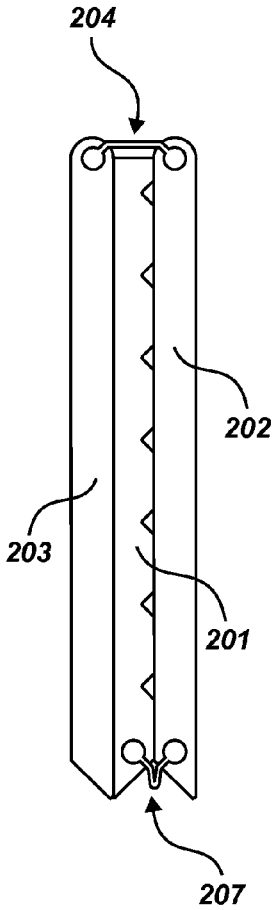
FIG. 10 is an elevation view of the panels folded and secured with the flexible living hinge system.

FIG. 10 is a view of the preferred embodiment of the panel assembly in the folded position and with the living hinges in place.

Figure 11:
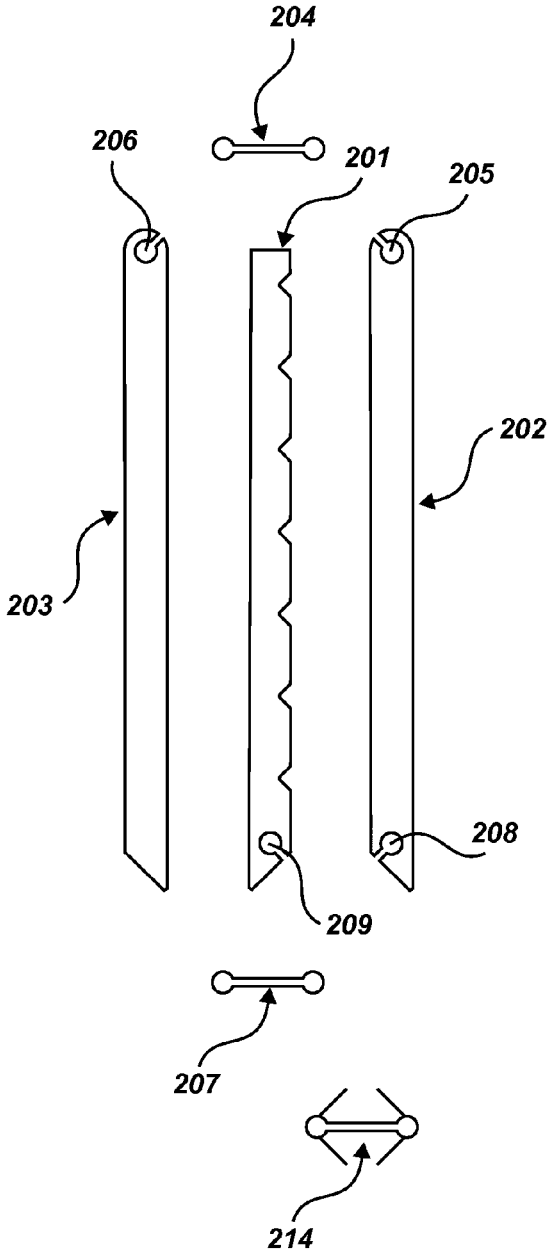
FIG. 11 is an elevation view of the panels separated from the flexible living hinge members.
Figure 12:
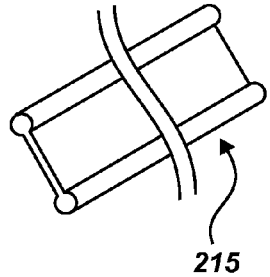
FIG. 12 is a perspective view of a flexible living hinge member.

FIG. 11 shows the preferred embodiment of the panel assembly with the living hinges 204 and 207 removed. Base panel 201 has means 209 to receive living hinge 207. Living hinge 207 also fits at 208 to secure the putter panel 202 to the base panel 201. Living hinge 204 secures driver or iron panel 203 to the putter panel at void 205. 215 of FIG. 12 shows the preferred embodiment of the flexible living hinge that runs longitudinally along the panels.

Living hinge 204 runs the length of panels 203 and 202 to form a smooth, integrated hinge that will not snag or snare a golfer or golf club. The rounded edges at living hinge insertion points 206 and 205 also adds to the safety of the invention as snagging is less likely to occur at rounded edges as compared to square edges. Golf clubs striking a rounded edge will be less damaged than clubs striking a square edge.

Figure 14:
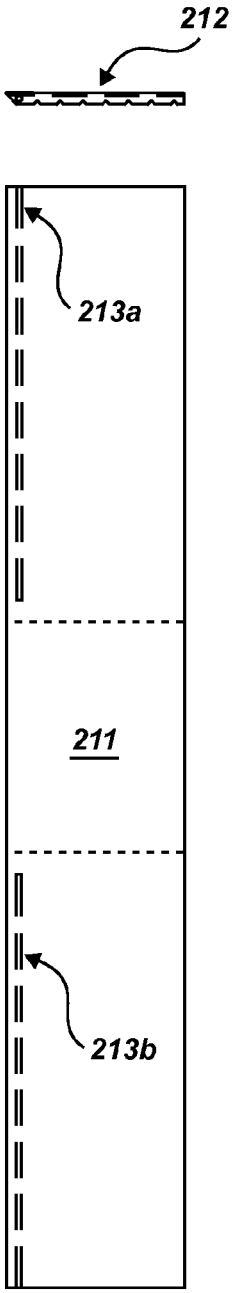
FIG. 14 is a plan view of the top side of the base panel.

Living hinge 207 runs along track 213*a* of FIG. 14. Hinge 207 stops at area 211 of FIG. 14 to allow insertion of the mirror assembly. An identical living hinge 207 runs along track 213*b* shown on FIG. 14.

214 of FIG. 11 shows an alternative embodiment of the living hinge wherein two or more barb structures protrude from either end of the hinge.

Figure 13:
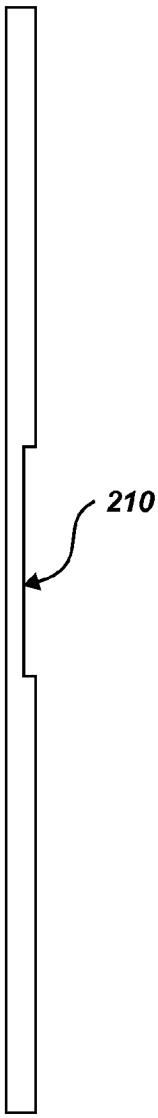
FIG. 13 is a plan view of the edge of the base panel.

FIG. 13 is an edge view of base panel 201 and shows the insertion area 210 for the reflective assembly 500. FIG. 14 is a sectional view of the base panel 201, showing the insertion tacks 213*a* and 213*b* for living hinge 207 of FIG. 11. 212 is an elevation view of base panel 201.

Figure 15:
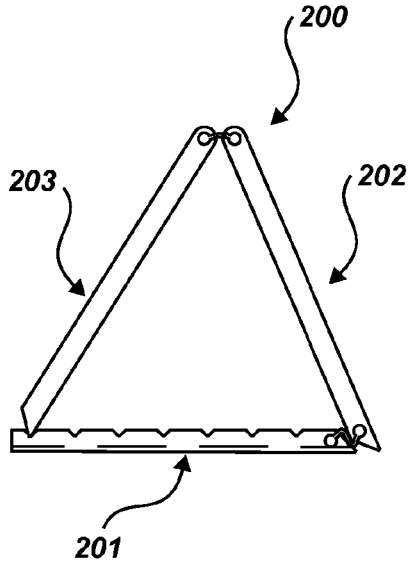
FIG. 15 is an elevation view of the panels in playing position.
Figure 16:
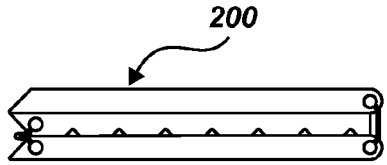
FIG. 16 is an elevation view of the panels in the folded position.

FIG. 15 is an elevation view of panel assembly 200 in position for use. FIG. 16 is an elevation view of panel assembly 200 in the folded position.

Figure 17:
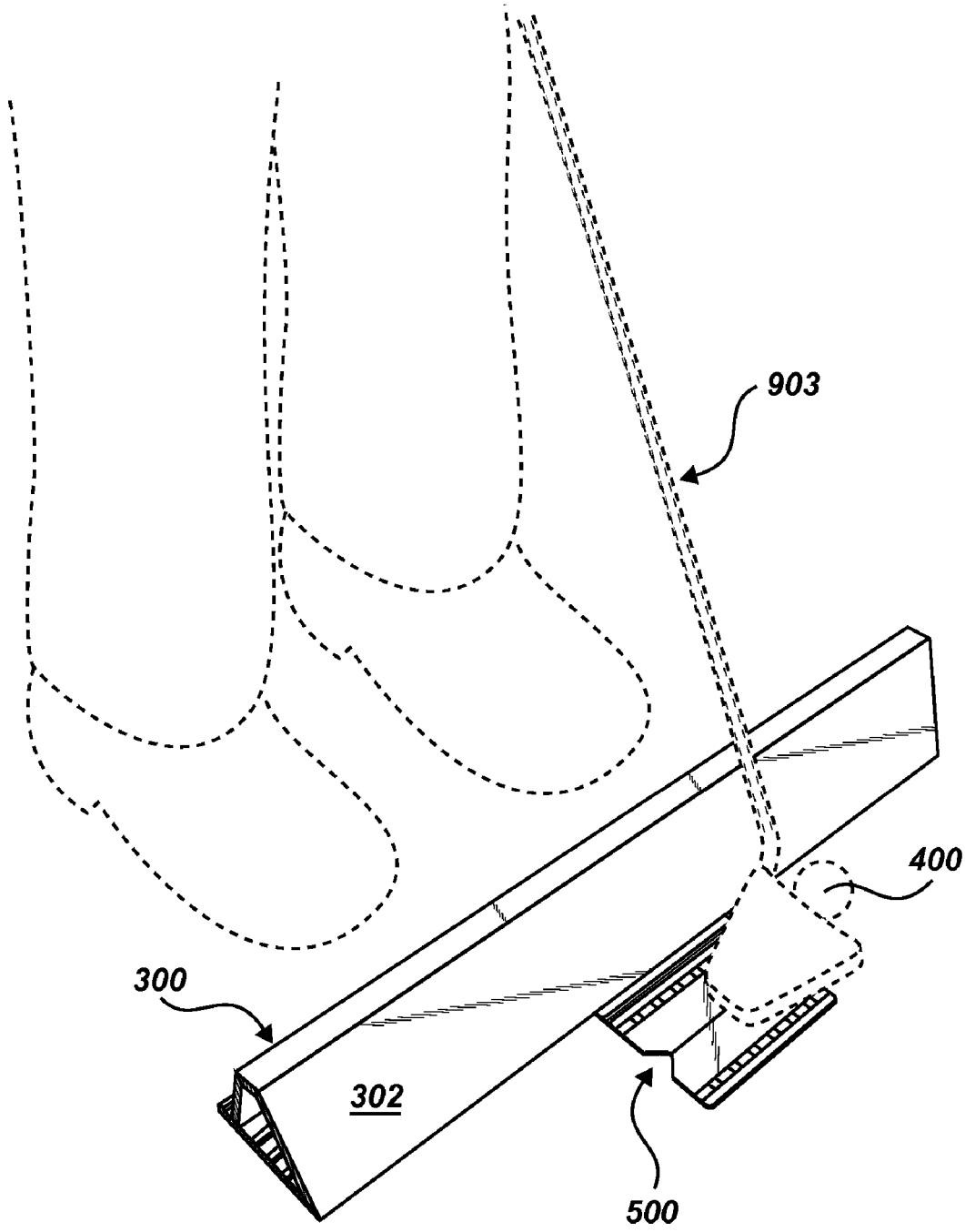
FIG. 17 is a perspective view of the panel system and reflective assembly used with a putter and golf ball.

FIG. 17 is a perspective view of a golfer sliding a putter 903 along the putter panel 302 and striking a golf ball 400. The reflective assembly 500 is fitted into the panel assembly 300 and is used for club and eye alignment.

What is claimed is:

1. A golf swing guide for directing and teaching the proper swing angle of drivers, irons, sand wedges and putters, the golf swing guide comprising:

a) a first rectangular panel generally flat on a first side and having five or more indentations on an opposite second side suitable for securing a third rectangular panel such that the five or more indentations provide means of defining the swing angle articulated in a second rectangular panel and third rectangular panel;

b) a second rectangular panel pivotally secured longitudinally by use of a living hinge to the first panel, wherein the second rectangular panel is of the same length of the first panel, so as to allow the second panel to rest in an adjustable upward position to guide a putting shot swing over the entire length of the second panel c) a third rectangular panel pivotally secured longitudinally by use of a living hinge to the second panel wherein the third rectangular panel may rest in an adjustable upward in position and is of the same length as the first and second panels so as to guide full swings, chipping shot swings, drive swings and iron swings across the entire surface of the third panel;

d) the first rectangular panel having the ability to rotate out from under the second and third panels such that the first rectangular panel may be buried in sand so as to allow the first flat side of the first rectangular panel to act as a splash board to guide a sand wedge swing or sand shot; and e) wherein the living hinge is substantially in the shape of an I-Beam, wherein the upper and lower part of the I-Beam fit into groves along the edges of the first and second panels and second and third panels and wherein the middle portions of the I-Beam are flexible and allow rotation between the first and second panels and second and third panels.

2. The device of claim 1 wherein either side of the I-Beam shaped living hinge have two or more protrusions.

* * * * *